US010835002B2

(12) United States Patent
Umekawa

(10) Patent No.: US 10,835,002 B2
(45) Date of Patent: Nov. 17, 2020

(54) ELECTRIC SLIDE FASTENER SYSTEM, RADIO TRANSMITTER, AND SLIDER AS RADIO RECEIVER

(71) Applicant: YKK Corporation, Tokyo (JP)

(72) Inventor: Toru Umekawa, Kurobe (JP)

(73) Assignee: YKK Corporation (JP)

( * ) Notice: Subject to any disclaimer, the term of this patent is extended or adjusted under 35 U.S.C. 154(b) by 61 days.

(21) Appl. No.: 16/324,966

(22) PCT Filed: Aug. 12, 2016

(86) PCT No.: PCT/JP2016/073744
§ 371 (c)(1),
(2) Date: Feb. 12, 2019

(87) PCT Pub. No.: WO2018/029851
PCT Pub. Date: Feb. 15, 2018

(65) Prior Publication Data

US 2019/0174877 A1 Jun. 13, 2019

(51) Int. Cl.
*A44B 19/26* (2006.01)

(52) U.S. Cl.
CPC ..... *A44B 19/26* (2013.01)

(58) Field of Classification Search
CPC .. A44B 19/26; Y10T 24/2566; Y10T 24/2561
See application file for complete search history.

(56) References Cited

U.S. PATENT DOCUMENTS 1,980,955 A * 11/1934 Norton ..... A44B 19/26
24/381
4,603,327 A * 7/1986 Leonard ..... A44B 19/301
200/DIG. 2

(Continued)

FOREIGN PATENT DOCUMENTS

CN 2925174 Y 7/2007
CN 204742860 U 11/2015

(Continued)

OTHER PUBLICATIONS

International Search Report, PCT Patent Application No. PCT/JP2016/073744, dated Nov. 8, 2016.

*Primary Examiner* — Robert Sandy
*Assistant Examiner* — Louis A Mercado
(74) *Attorney, Agent, or Firm* — Kilpatrick Townsend & Stockton LLP

(57) ABSTRACT

To provide an electric slide fastener system, a radio transmitter, and a slider as a radio receiver that are able to operate adequately according to the state of an electric slider. An electric slide fastener system is provided with: a slide fastener chain including a pair of fastener tapes and element strips including a plurality of elements fixed to the fastener tapes; a slider configured to be movable relative to the slide fastener chain and including at least a power supply, a control part including a reception part for receiving a radio signal, and an output part including a drive part for driving an electric motor and a transmitting part for transmitting a drive force to the element strips; and a radio input part for transmitting by radio an instruction signal to the slider.

11 Claims, 15 Drawing Sheets

(56) References Cited

U.S. PATENT DOCUMENTS

| | | | | |
|---|---|---|---|---|
| 4,755,802 | A * | 7/1988 | Urbanczyk | A45C 13/24 116/84 |
| 6,026,546 | A * | 2/2000 | Lund | A44B 19/262 24/415 |
| 10,076,163 | B2 * | 9/2018 | Umekawa | A44B 19/02 |
| 2006/0193122 | A1 * | 8/2006 | Chang | F21V 33/0008 362/103 |
| 2006/0196017 | A1 * | 9/2006 | Turner | A44B 19/26 24/381 |
| 2006/0290497 | A1 * | 12/2006 | Sugata | A44B 1/08 340/572.1 |
| 2007/0271743 | A1 * | 11/2007 | Chou | H01Q 1/273 24/431 |
| 2015/0082582 | A1 | 3/2015 | Whiton | |

FOREIGN PATENT DOCUMENTS

| | | | |
|---|---|---|---|
| JP | H01-313002 | A | 12/1989 |
| JP | H10-000108 | A | 1/1998 |
| JP | 2000-189218 | A | 7/2000 |
| JP | 2001-269203 | A | 10/2001 |
| JP | 2002-125722 | A | 5/2002 |
| JP | 2009-077947 | A | 4/2009 |

* cited by examiner

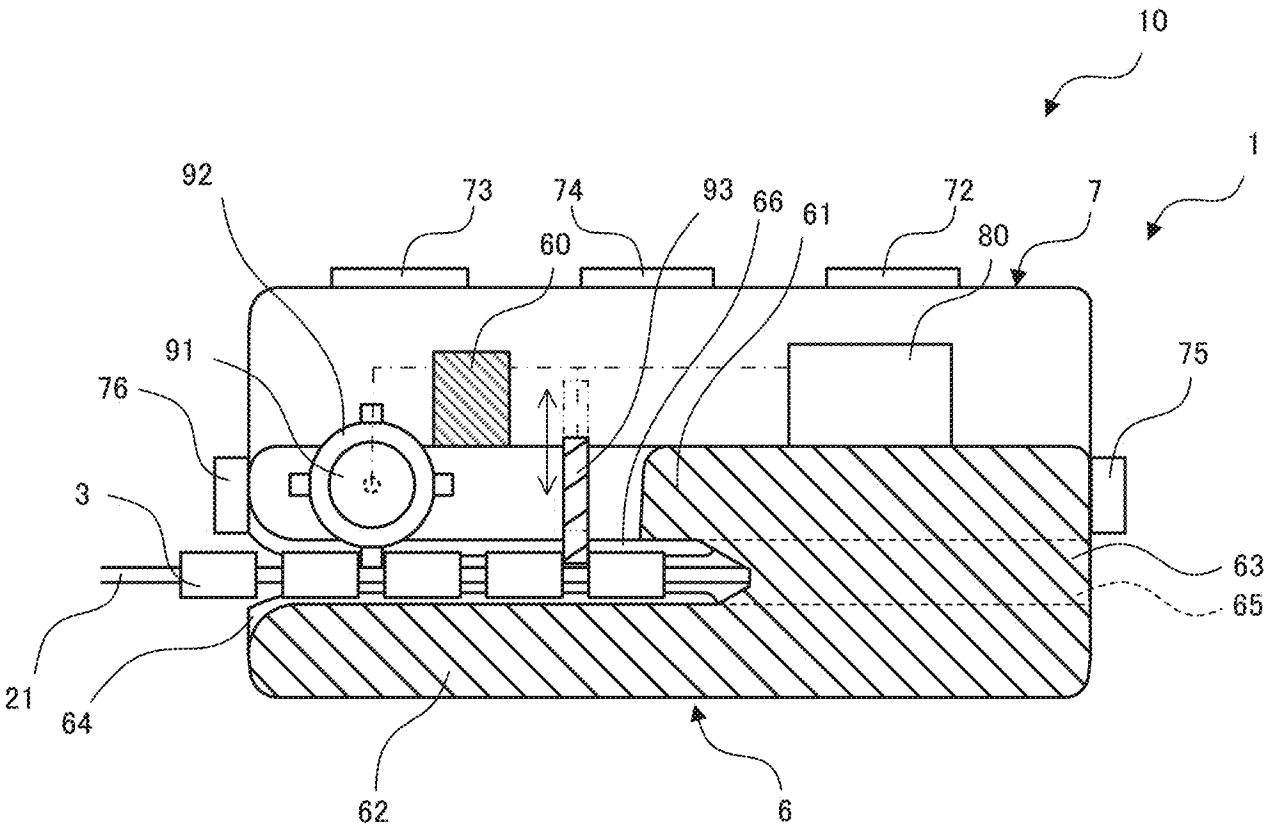
FIG. 2
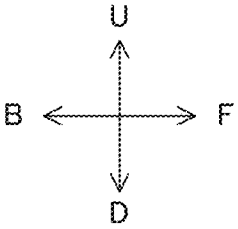

ELECTRIC SLIDE FASTENER SYSTEM, RADIO TRANSMITTER, AND SLIDER AS RADIO RECEIVER

TECHNICAL FIELD

The present invention relates to an electric slide fastener system that electrically moves a slider, a radio transmitter, and a slider as a radio receiver.

BACKGROUND ART

Electric sliders configured to electrically move a slider are conventionally disclosed (Patent Documents 1 to 5).

CITATION LIST

Patent Document

Patent Document 1: JP 2001-269203 A
Patent Document 2: JP 2009-077947 A
Patent Document 3: China Utility Model Registration No. 2925174
Patent Document 4: China Utility Model Registration No. 204742860
Patent Document 5: U.S. Unexamined Patent Application Publication No. 2015/0082582

DISCLOSURE OF THE INVENTION

Problems to be Solved by the Invention

However, although Patent Documents 1 to 4 describe the mechanical configuration of an electric motor or a gear transmission mechanism, the disclosed sliders still have many defects to be overcome for practical use: unable to respond to complicated operation such as automatic control; involving troublesome operation of manually powering ON; involving troublesome operation of exchanging battery every time the battery runs out; unable to reliably stop the slider at its stop position at the time of motor stop; and the like.

The electric slider described in Patent Document 5 uses an optical sensor that detects the number of teeth of a zipper; however, the above-mentioned defects have not completely been solved.

The present invention has been made to solve the above defects and the object thereof is to provide an electric slide fastener system, a radio transmitter, and a slider as a radio receiver that are able to operate adequately according to the state of an electric slider.

Means for Solving the Problems

An electric slide fastener system according to an embodiment of the present invention includes: a slide fastener chain including a pair of fastener tapes and element strips including a plurality of elements fixed to the fastener tapes; a slider configured to be movable relative to the slide fastener chain and including at least a power supply, a control part including a reception part for receiving a radio signal, and an output part including a drive part for driving an electric motor and a transmitting part for transmitting a drive force to the element strips; and a radio input part for transmitting by radio an instruction signal to the slider.

In the electric slide fastener system according to the embodiment of the present invention, the radio input part includes at least a closing switch for transmitting a radio signal for moving the slider in a direction closing the slide fastener chain and an opening switch for transmitting a radio signal for moving the slider in a direction opening the slide fastener chain.

In the electric slide fastener system according to the embodiment of the present invention, the radio input part has a target position input part for inputting a target position to which the slider is moved.

In the electric slide fastener system according to the embodiment of the present invention, the radio input part has a function selecting part. The function selecting part can select one mode from at least two modes. The two modes include a combination of a manual mode in which the slider is moved while the radio input part is manually operated and an automatic mode in which the slider is automatically moved to and stopped at a predetermined target position, or a combination of the automatic mode in which the slider is automatically moved to and stopped at a predetermined target position and a target position input mode in which a predetermined target position is input.

In the electric slide fastener system according to the embodiment of the present invention, the radio input part has a position display part for displaying the current position of the slider.

In the electric slide fastener system according to the embodiment of the present invention, the radio input part is a touch panel type mobile communication terminal.

A radio transmitter according to an embodiment of the present invention is a radio input part as a radio transmitter for transmitting a radio signal to a slider for opening/closing a slide fastener so as to remotely control the slider. The radio input part includes at least a closing switch for transmitting a radio signal for moving the slider in a direction closing the slide fastener chain, an opening switch for transmitting a radio signal for moving the slider in a direction opening the slide fastener chain, and a stop switch. The radio input part optionally has a first radio signal conversion part that generates a radio signal according to an operation time for the closing switch, opening switch and stop switch.

A radio transmitter according to an embodiment of the present invention is a radio input part as a radio transmitter for transmitting a radio signal to a slider for opening/closing a slide fastener so as to remotely control the slider. The radio input part has a target position input part for inputting a target position to which the slider is moved. The radio input part further has a first radio signal conversion part that generates a radio signal according to a setting value set in the target position input part.

In the radio transmitter according to the embodiment of the present invention, the radio input part has a start button for starting, after the target position is set, the movement of the slider to the target position, and the first radio signal conversion part generates a radio signal according to the operation state of the start button.

A slider as a radio receiver according to an embodiment of the present invention is a slider as a radio receiver for receiving a radio signal for opening/closing a slide fastener. The radio receiver has a second radio signal conversion part that converts a radio signal transmitted thereto according to the operation state of a closing switch and an opening switch of a radio input part as a radio transmitter into a drive signal for a drive part of the slider.

A slider as a radio receiver according to an embodiment of the present invention is a slider as a radio receiver for receiving a radio signal for opening/closing a slide fastener. The radio receiver has a second radio signal conversion part that converts a radio signal transmitted thereto according to a value set in a target position input part of a radio input part as a radio transmitter into a signal to be stored in a storage part of a control part of the slider.

In the slider as the radio receiver according to the embodiment of the present invention, the second radio signal conversion part converts a radio signal transmitted thereto according to the operation state of a start button of the radio input part as the radio transmitter into a signal for start-up of a drive part of the slider.

Advantageous Effects of the Invention

According to the present invention, there can be provided an electric slide fastener system, a radio transmitter, and a slider as a radio receiver that are able to operate adequately according to the state of the electric slider.

BRIEF DESCRIPTION OF THE DRAWINGS

FIG. 2 is a cross-sectional view of a slider of the electric slide fastener system according to the first embodiment taken along line II-II in FIG. 1;

BEST MODE FOR CARRYING OUT THE INVENTION

Hereinafter, an electric slider 6 and an electric slide fastener system 10 according to an embodiment of the present invention will be described concretely based on the drawings.

Figure 1:
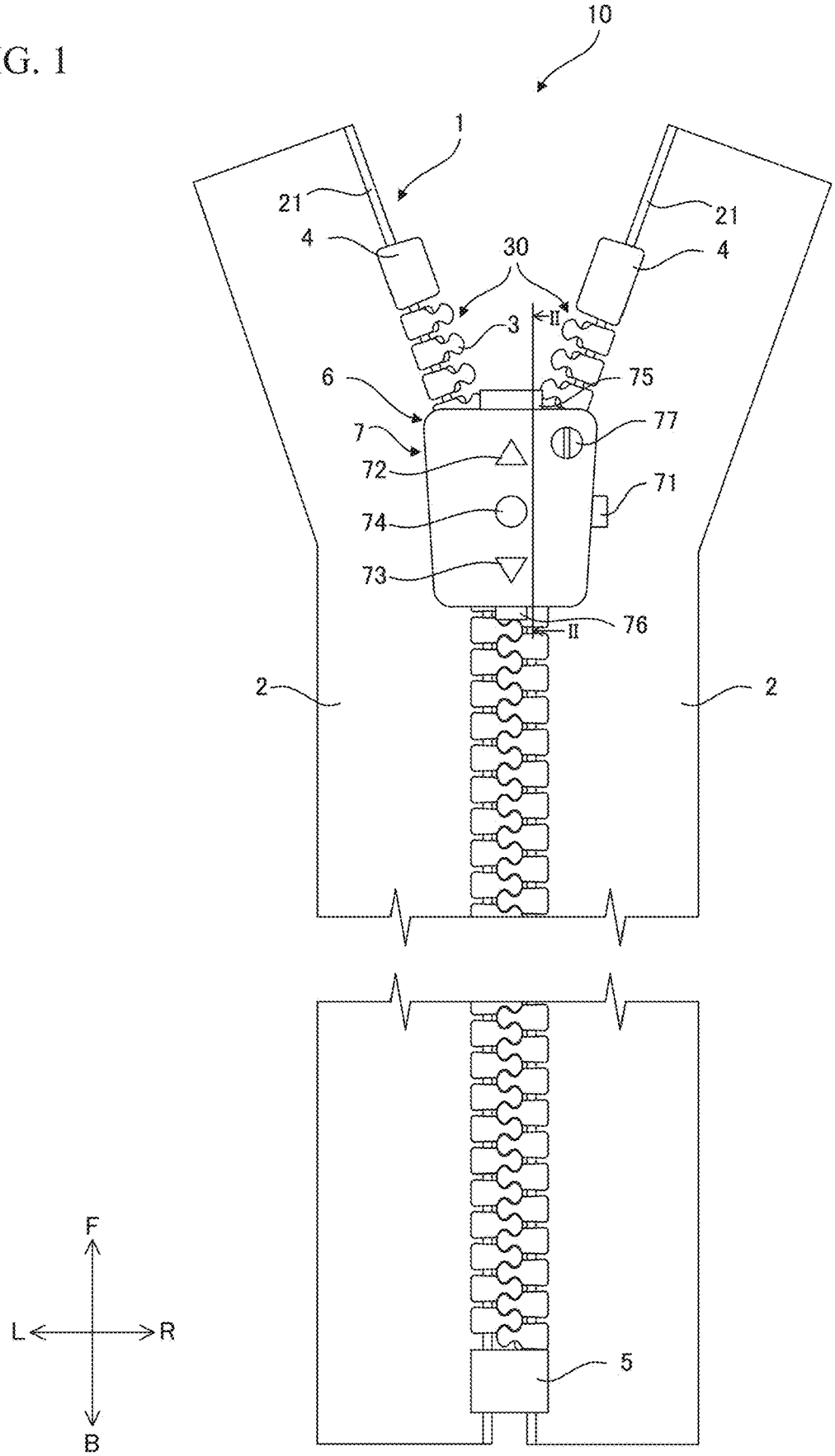
FIG. 1 is a front view of an electric slide fastener system according to a first embodiment.

FIG. 1 is a front view of the electric slide fastener system 10 according to a first embodiment. FIG. 2 is a cross-sectional view of the slider 6 of the electric slide fastener system according to the first embodiment taken along line II-II in FIG. 1.

The slide fastener system 10 according to the first embodiment includes a pair of fastener tapes 2 and 2, a plurality of elements 3 formed at predetermined intervals along opposing conductive parts 21 of the respective fastener tapes 2, stoppers 4 and 5 fixed to the conductive parts 21 of the respective fastener tapes 2 at the ends of respective element strips 30 formed by the plurality of elements 3, and a slider 6 that moves along the elements 3 to make the elements 3 be engaged with each other or separated from each other. The element strips 30 have their ends in the front-back direction of a slide fastener chain 1. The stoppers includes front stoppers 4 disposed at the front ends of the element strips 30 and a back stopper 5 disposed at the back ends of the element strips 30. The elements 3 are each made of a resin material.

In the slide fastener chain 1 according to the present embodiment, the length direction of the fastener tapes 2 is defined as the front-back direction (F-B direction) and denoted by arrows F and B. Further, the width direction of the fastener tapes 2 is defined as the left-right direction (L-R direction) and denoted by arrows L and B. Further, the front-back direction of the fastener tapes 2 is defined as the up-down direction (U-D direction) and denoted by arrows U and D.

The slide fastener chain 1 includes the pair of left and right fastener tapes 2 and the plurality of elements 3 arranged at predetermined intervals in the length direction of the fastener tapes 2 and fixed to the opposing conductive parts 21 of the respective fastener tapes 2. The slider 6 moves along the elements 3 in the front-back direction of the slide fastener chain 1 to thereby make the elements 3 be engaged with each other or separated from each other.

The fastener tapes 2 each have the conductive part 21 protruding from the upper and lower surfaces thereof and extending in the front-back direction thereof. The elements 3 are fixed to the conductive parts 21 of the respective fastener tapes 2. The fastener tapes 2 each have an upper surface 2*a* and a lower surface 2*b*. The upper surface 2*a* side is defined as the right side (of the fastener tapes 2) when they are attached to clothes or a bag as a slide fastener, and the lower surface 2*b* side is defined as the back of the upper surface 2*a*. The embodiment described here is an example in which power can be externally fed through the conductive parts 21. When external power feeding is not necessary, a normal fastener tape core strip structure may be adopted without use of the conductive parts 21.

The front stoppers 4 are disposed respectively at the front ends of the element strips 30 of the pair of fastener tapes 2. On the other hand, only one back stopper 5 is disposed at the back ends of the pair of fastener tapes 2. The back stopper 5 connects the fastener tapes 2 to prevent separation of the elements 3 from each other and separation of the fastener tapes 2 from each other. The back stopper 5 is not limited to the illustrated example. For example, the back stopper 5 may be configured to have a not-shown insertion rod fixed to the back end of the element strip 30 of one fastener tape 2 and a box fixed to the back end of the element strip 30 of the other fastener tape 2 and having a not-shown hole into which the insertion rod can be inserted. In this case, the fastener tapes 2 can be separated from each other together with separation of the elements 3 from each other. The slider 6 can move in the front-back direction of the slide fastener chain 1 between the front stoppers 4 and the back stopper 5.

A body 61 of the slider 6 includes an upper wing plate 61, a lower wing plate 62, and a guide column 63 connecting the front F side of the upper wing plate 61 and the front F side of the lower wing plate 62. A not-shown upper wing flange for guiding the fastener elements 3 protrudes from the back B side of the upper wing plate 61 and lower wing plate 62 at the side edge of the body 61 in the left-right direction. A shoulder opening 64 is formed between the upper wing plate 61 and the lower wing plate 62 at the front side of the body 61 on both the right and left sides of the guide column 63, and a back opening 65 is formed at the back end of the body 61. Further, a guide groove 66 is formed so as to be connected to the shoulder opening 64 and the back opening 65 and thus to guide the fastener elements 3.

Figure 3:
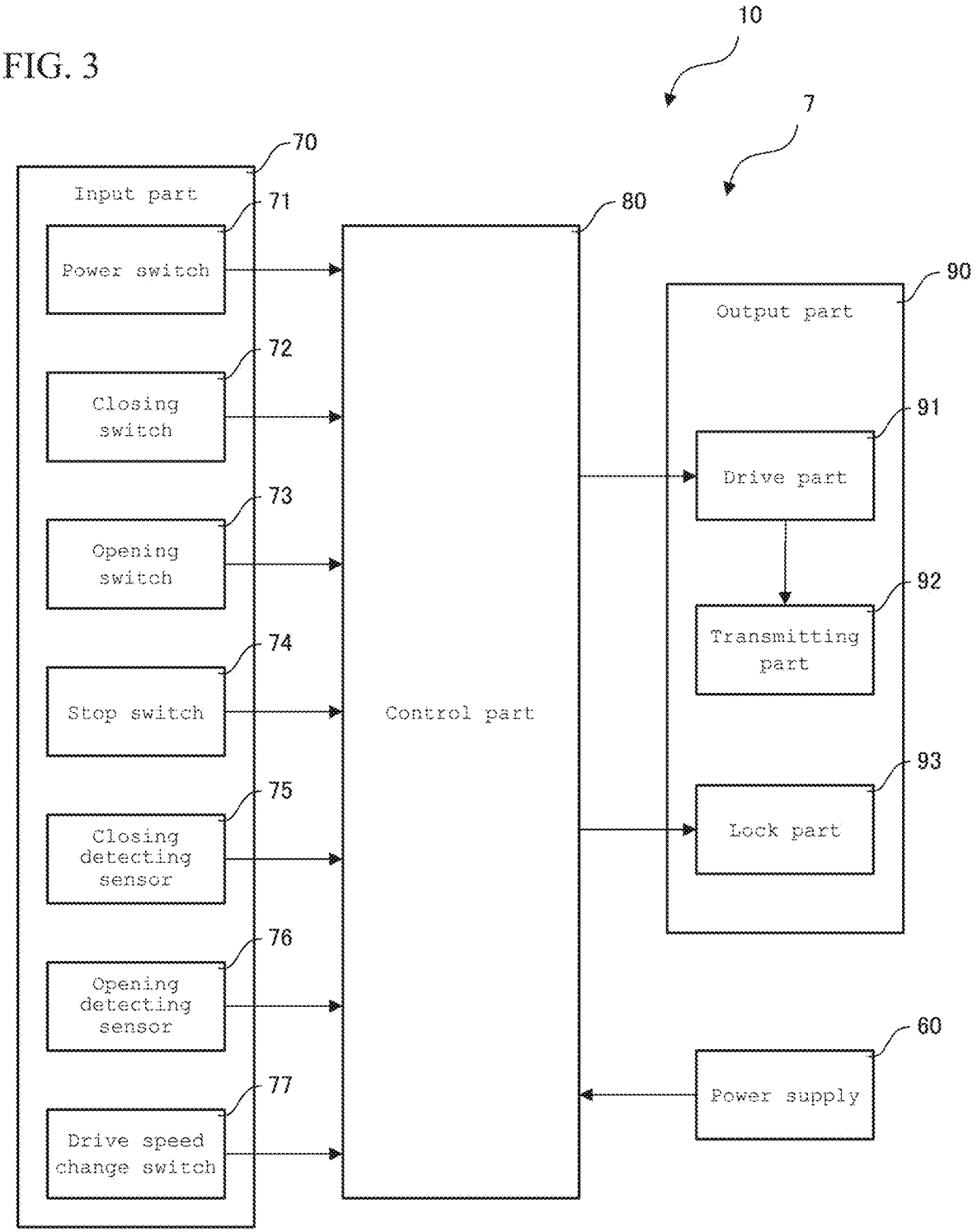
FIG. 3 is a control block diagram of the electric slide fastener system according to the first embodiment.

FIG. 3 is a control block diagram of the electric slide fastener system 10 according to the first embodiment.

The slider 6 includes a control unit 7. The control unit 7 includes a power supply 60, an input part 70, a control part 80, and an output part 90. The slider 6 also has a function and a role as a radio receiver for receiving a radio signal for opening/closing the slide fastener. The power supply 60 is preferably a rechargeable battery; however, when the conductive part 21 is not used, it may be an exchangeable disposable battery. When a rechargeable battery is used as the power supply 60, the battery may be charged by a feeding system to be described later.

The input part 70 includes a power switch 71, a closing switch 72, an opening switch 73, a stop switch 74, a closing detecting sensor 75, an opening detecting sensor 76, and a drive speed change switch 77.

The power switch 71 is a switch for starting power feeding from the power supply 60 in the control unit 7 and is a push-button switch, a slide switch, or the like. The closing switch 72 is a switch for moving the slider 6 in the closing direction and is a push-button switch, a slide switch, or the like. For example, when the closing switch 72 is turned ON, the drive part 91 is driven to move the slider 6 in the closing direction. The opening switch 73 is a switch for moving the slider 6 in the opening direction and is a push-button switch, a slide switch, or the like. For example, when the opening switch 73 is turned ON, the drive part 91 is driven to move the slider 6 in the opening direction. As illustrated in FIG. 1, the closing switch 72 and opening switch 73 according to the first embodiment are each a push-button switch having a triangular shape with its one vertex facing the moving direction.

The stop switch 74, which is a switch for stopping the movement of the slider 6 is a push-button switch, a slide switch, or the like. For example, when the stop switch 74 is turned ON, the drive part 91 is stopped to stop the movement of the slider 6. As illustrated in FIG. 1, the stop switch 74 according to the first embodiment is a round push-button switch disposed between the closing switch 72 and the opening switch 73. When a slide switch is adopted for the above switches, the following configuration is possible: the slider 6 is stopped when the slide switch is positioned at the center, the slider 6 is moved in the closing direction when the slide switch is positioned on the closing direction side, and the slider 6 is moved in the opening direction when the slide switch is positioned on the opening direction side.

The closing detecting sensor 75 and opening detecting sensor 76 are each a sensor for detecting arrival of the slider 6 at the stoppers 4 or stopper 5. As illustrated in FIG. 1, in the first embodiment, the closing detecting sensor 75 detects contact of the slider 6 with the front stoppers 4, and the opening detecting sensor 76 detects contact of the slider 6 with the back stopper 5. The arrival of the slider 6 at the stoppers 4 or stopper 5 may be detected using an optical sensor or the like.

The drive speed change switch 77 is a switch that changes the drive speed of the drive part 91 to change the moving speed of the slider 6. The drive speed change switch 77 according to the first embodiment is a dial switch that adjusts the drive speed by its rotation. The drive speed change switch 77 may be a slide switch or a push-button switch.

The output part 90 includes a drive part 91, a transmitting part 92, and a lock part 93. The drive part 91 moves the slider 6 by a torque generated in the transmitting part 92. The lock part 93 locks movement of the slider 6 while the slider 6 is stopped. The drive part 91 and transmitting part 92 are illustrated in a simplified manner since various forms thereof like those described in above Patent Documents 1 to 5 are known. The arrangement positions of the drive part 91 and transmitting part 92 described in the present specification are illustrative only, and they can be arranged at any position as long as the torque of the transmitting part 92 can be converted into advancing force of the slider 6. It should be understood that the configurations of the drive part 91 and transmitting part 92 include those described in the above Patent Documents 1 to 5 and various other configurations that can be conceived therefrom in view of the mechanical design.

As illustrated in FIG. 2, in the first embodiment, a motor is used as the drive part 91 to thereby rotate a gear as the transmitting part 92. The transmitting part 92 includes a reduction gear having an adequate reduction ratio. The gear to be rotated is rotatably supported by the slider 6. The drive part 91 is driven when the closing switch 72 or opening switch 73 is turned ON. Then, the gear is rotated and moved while being engaged with the elements 3, whereby the slider 6 is moved. Thereafter, when the stop switch 74 is turned ON, the drive part 91 is stopped. A torque limiter function is preferably added to the drive part 91 and, when the torque of the drive part 91 exceeds a threshold value, the drive part 91 is stopped.

In the first embodiment, the lock part 93 is supported so as to be movable relative to the slider 6 such that it can be advanced or retreated to or from between the adjacent elements 3. The lock part 93 moves between the elements 3 after turning ON of the stop switch 74, stopping the drive part 91 and slider 6. Then, the lock part 93 is inserted between the elements 3, whereby the slider 6 is locked at that position. Thereafter, the lock may be released when the closing switch 72 or opening switch 73 is turned ON. Alternatively, the lock part 93 may be activated after turning ON of the closing detecting sensor 75 or opening detecting sensor 76, stopping the drive part 91 and slider 6. A mechanism that can manually release the lock is preferably provided in the lock part 93 so as to be able to cope with a case where power supply to the slider 6 fails.

The lock part 93 is configured to be movable by an actuator such as a solenoid. For example, the lock part 93 may be biased by a spring or the like in between the elements 3 and may slip off between the elements 3 by the action of the actuator. The lock part 93 may be omitted.

Figure 4:
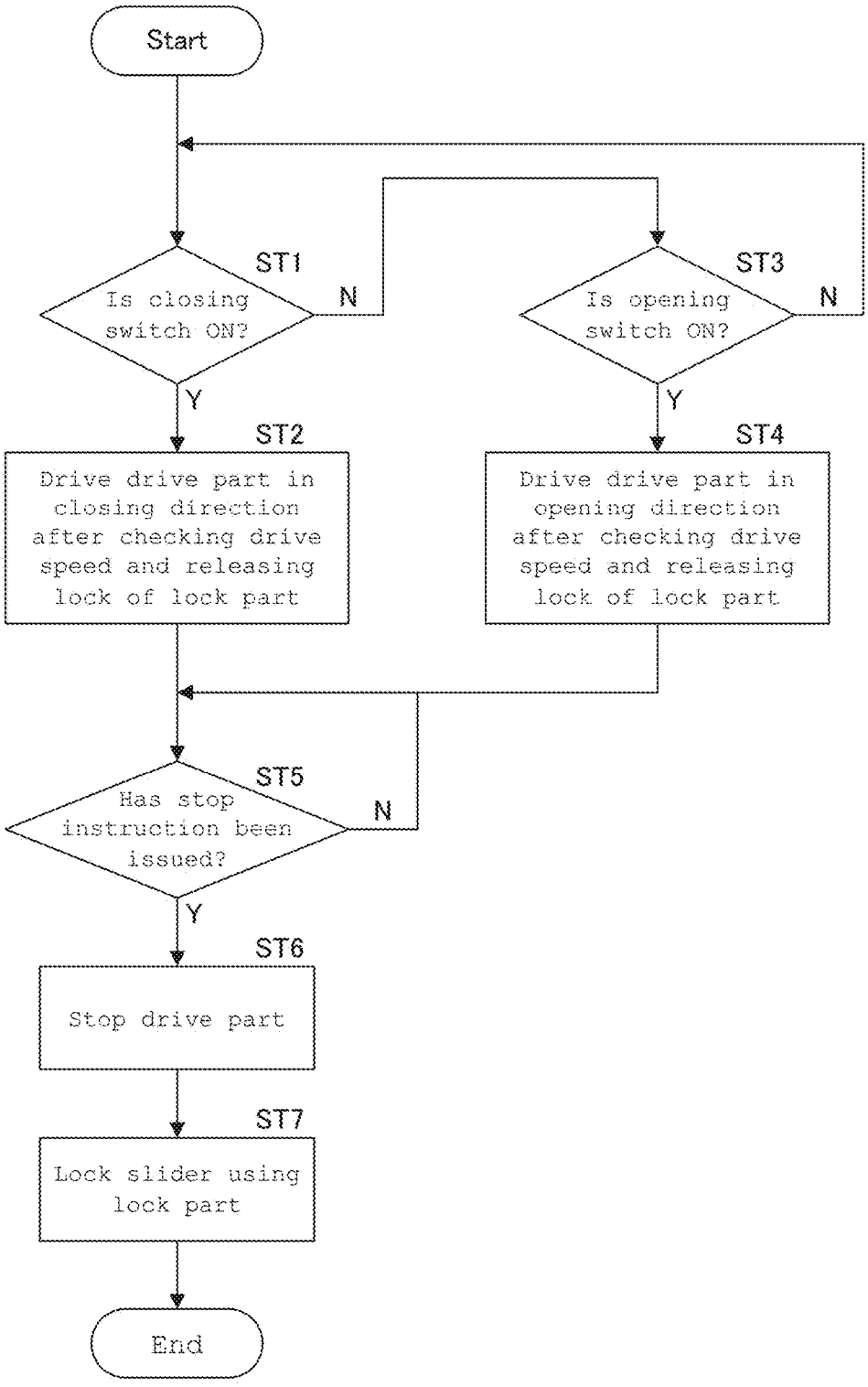
FIG. 4 is a control flow of the electric slide fastener system according to the first embodiment.

FIG. 4 is a control flow of the electric slide fastener system 10 according to the first embodiment.

Upon turning ON of the power switch 71, the control part 80 (FIG. 3) of the electric slide fastener system 10 according to the first embodiment starts its control operation.

In step 1, it is determined whether or not the closing switch 72 is turned ON (ST1). When it is determined in step 1 that the closing switch 72 is turned ON, the flow proceeds to step 2. On the other hand, when it is determined in step 1 that the closing switch 72 is not turned ON, the flow proceeds to step 3.

In step S2, after checking of the drive speed and release of the lock of the lock part 93, the drive part 91 is driven in the closing direction (ST2). Then, the flow proceeds to step 5. When the lock part 93 is not provided, the release of the lock part 93 is not executed.

In step 3, it is determined whether or not the opening switch 73 is turned ON (ST3). When it is determined in step 3 that the opening switch 73 is turned ON, the flow proceeds to step 4. On the other hand, when it is determined in step 3 that the opening switch 73 is not turned ON, the flow returns to step 1.

In step 4, after checking of the drive speed and release of the lock of the lock part 93, the drive part 91 is driven in the opening direction (ST4). Then, the flow proceeds to step 5. When the lock part 93 is not provided, the release of the lock part 93 is not executed.

In step 5, it is determined whether or not a stop instruction has been issued (ST5). In the first embodiment, the stop instruction is issued when the stop switch 74, closing detecting sensor 75, or opening detecting sensor 76 is turned ON. The determination of turning ON of the stop switch 74 is made by determining whether or not the stop switch 74 is turned ON by an operator. The determination of turning ON of the closing detecting sensor 75 or opening detecting sensor 76 is made by determining whether or not the slider 6 has reached the stoppers 4 or stopper 5.

When it is determined in step 5 that a stop instruction has been issued, the flow proceeds to step 6. On the other hand, when it is determined in step 5 that no stop instruction has been issued, the flow returns to step 5. That is, the drive part 91 is continuously driven until the stop instruction is issued.

In step 6, the drive part 91 is stopped in response to the stop instruction (ST6). The stop of the drive part 91 stops the slider 6. When the stop switch 74 is turned ON, the slider 6 is stopped at that position. When the closing detecting sensor 75 is turned ON, the slider 6 is stopped in a state where it contacts the front stoppers 4. When the opening detecting sensor 76 is turned ON, the slider 6 is stopped in a state where it contacts the back stopper 5.

Then, in step 7, the lock part 93 is moved to lock the movement of the slider 6 (ST7). When the lock part 93 is not provided, step 7 is not executed.

As described above, by thus controlling the electric slide fastener, the state of the slider 6 can be detected, and the slider 6 can be controlled according to the detected state, whereby adequate operation of the slider 6 can be achieved. Further, contact of the slider 6 with the front stoppers 4 disposed at the closing side end portion of the element strips 30 allows detection of the closing of the element strips 30, and contact of the slider 6 with the back stopper 5 disposed at the opening side end portion of the element strips 30 allows detection of the opening of the element strips 30, whereby completion of the closing/opening of the element strips 30 can be adequately detected for stop of the slider 6.

Further, when the lock part 93 is provided, the lock part 93 can lock the movement of the slider 6 relative to the slide fastener chain 1 after the stop of the slider 6, so that the slider 6 can be stably stopped at a desired position, enhancing user convenience and friendliness.

Figure 5:
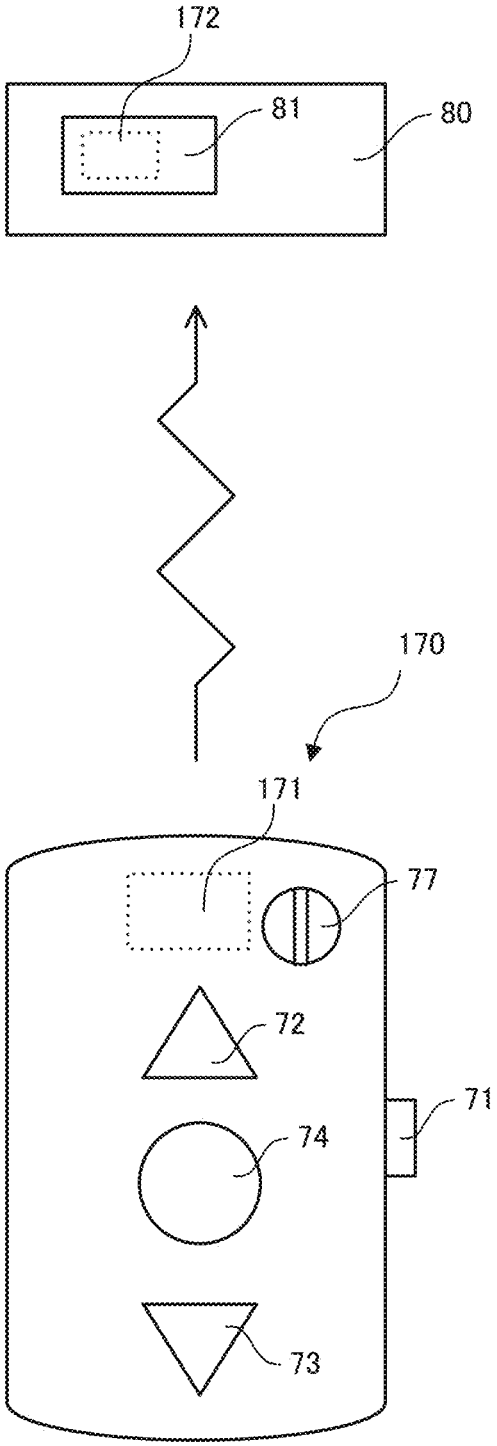
FIG. 5 illustrates a radio input part of the electric slide fastener system according to the first embodiment.

FIG. 5 illustrates a radio input part 170 of the electric slide fastener system 10 according to the first embodiment. The radio input part 170 functions as a radio transmitter that transmits a radio signal to the slider 6 for opening/closing the slide fastener to remotely control the slider 6.

The radio input part 170 includes a power switch 71, a closing switch 72, an opening switch 73, a stop switch 74, and a drive speed change switch 77. The radio input part 170 has a first radio signal conversion part 171 that generates a radio signal according to which one of the closing switch 72, opening switch 73 and stop switch 74 is selected. The radio input part 170 transmits the generated signal to the control part 80 of the slider 6 by radio. The control part 80 has a reception part 81 that receives the signal from the radio input part 170. The control part 80 has a second radio signal conversion part 172 that converts the received radio signal corresponding to one of the closing switch 72, opening switch 73 and stop switch 74 of the radio input part 170 as the radio transmitter into a drive signal for driving the drive part 91 of the slider 6. The operation contents of the slider 6 corresponding to the respective switches are the same as those of the input part 70 described above.

As the radio input part 270, a touch panel type mobile communication terminal may be used. Specifically, a mobile communication terminal like a smartphone may be used. In this case, the mobile communication terminal is preferably operated by a dedicated application. Further, in this case, button arrangement illustrated in FIG. 9 may be displayed as the radio input part 270 on the screen of the mobile communication terminal.

As described above, using the radio input part 170 allows the control of the slider 6 even from a position remote from the slider 6.

Figure 6:
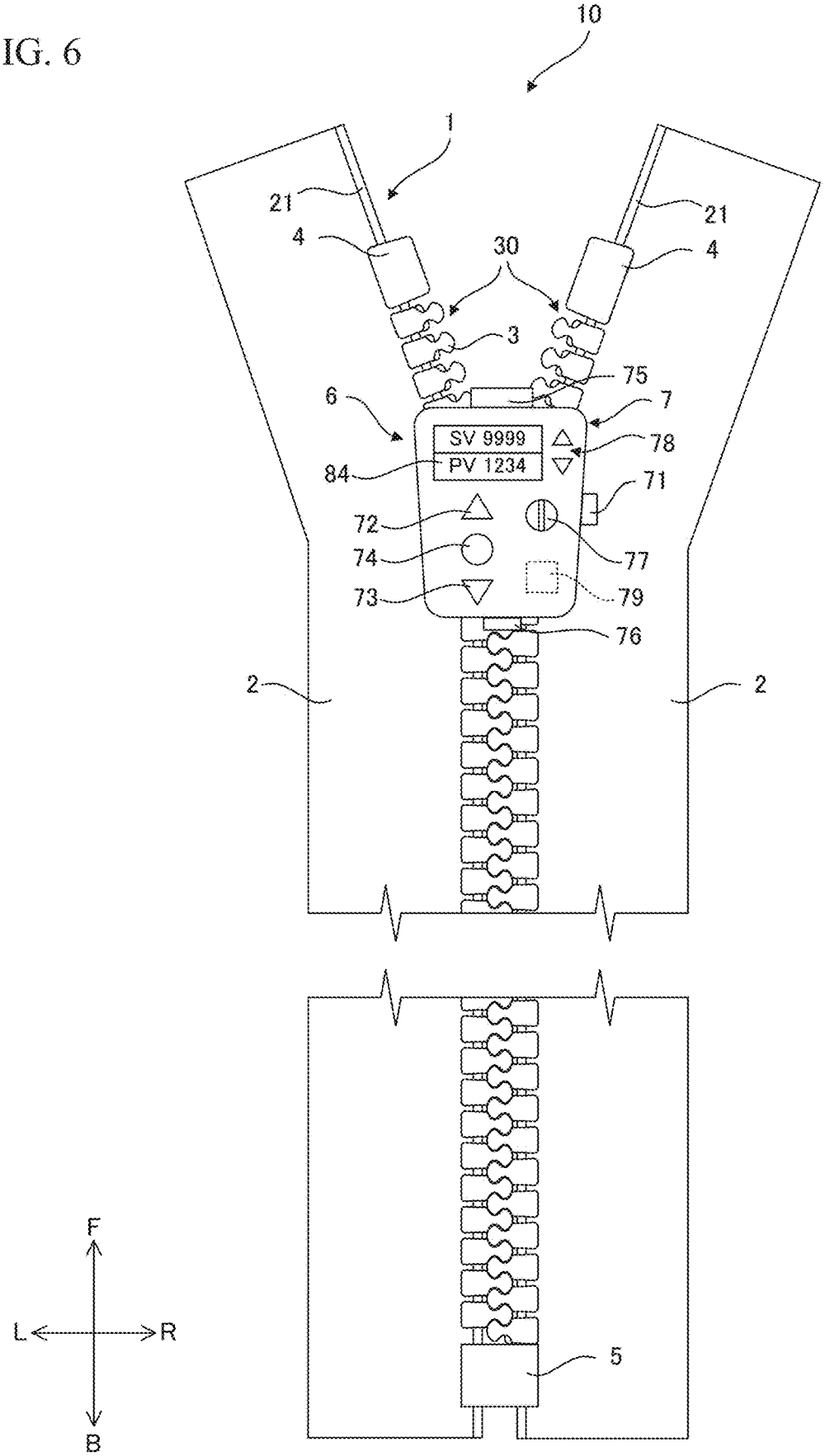
FIG. 6 is a front view of an electric slide fastener system according to a second embodiment.

FIG. 6 is a front view of an electric slide fastener system 10 according to a second embodiment.

The configuration of the slide fastener chain 1 in the electric slide fastener system 10 according to the second embodiment is the same as that of the first embodiment, so descriptions thereof will be omitted.

Figure 7:
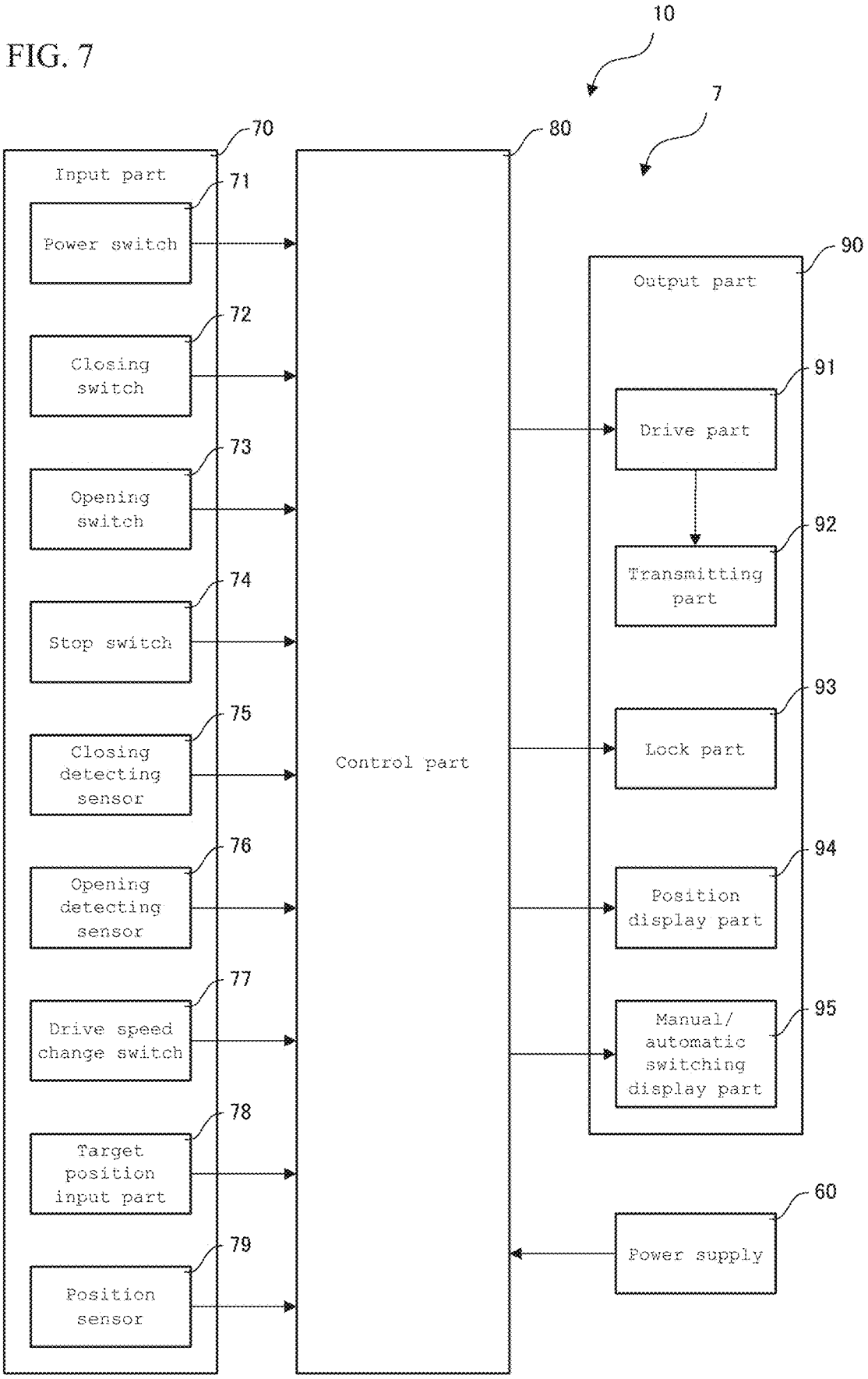
FIG. 7 is a control block diagram of the electric slide fastener system according to the second embodiment.

FIG. 7 is a control block diagram of the electric slide fastener system 10 according to the second embodiment.

The slider 6 includes a control unit 7. The control unit 7 includes the input part 70, control part 80 and output part 90.

The input part 70 includes the power switch 71, closing switch 72, opening switch 73, stop switch 74, closing detecting sensor 75, opening detecting sensor 76, drive speed change switch 77, a target position input part 78, and a position sensor 79. The output part 90 includes the drive part 91, transmitting part 92, lock part 93, and a position display part 94. The control unit 7 according to the second embodiment has the same configuration as the first embodiment except for the target position input part 78, the position sensor 79 and the position display part 94, so descriptions of the parts other than the target position input part 78, the position sensor 79 and the position display part 94 will be omitted.

When the positions of the front stoppers 4 and back stopper 5 are previously stored as the upper and lower limit values of the target position input part 78, the closing detecting sensor 75 and opening detecting sensor 76 need not be used. In this case, a torque limiter function is preferably added to the drive part 91 and, when the torque of the drive part 91 exceeds a threshold value, the drive part 91 is stopped.

The target position input part 78 inputs a target position of the slider 6. As illustrated in FIG. 6, in the present embodiment, the target position input part 78 is a push-button switch having two triangles each with its one vertex facing the moving direction. Pushing the button allows a desired target position to be set. The target position is set with the number of the elements 3, distance from the current position of the slider 6, distance from the front stoppers 4 or back stopper 5, or time as a reference unit.

The position sensor 79 detects the position of the slider 6. The position of the slider 6 is detected by a method that detects the elements 3 in a contact manner or an optical manner and counts the number of the elements 3, a method that detects a distance from the front stoppers 4 or back stopper 5, a method that detects a detected part installed at a predetermined location, or the like.

The position display part 94 displays a target position input by the target position input part 78 and the position of the slider 6 detected by the position sensor 79. For example, the position display part 94 according to the second embodiment displays "9999" input by the target position input part 78 as a target position SV and displays "1234" detected by the position sensor 79 as a current value PV.

Figure 8:
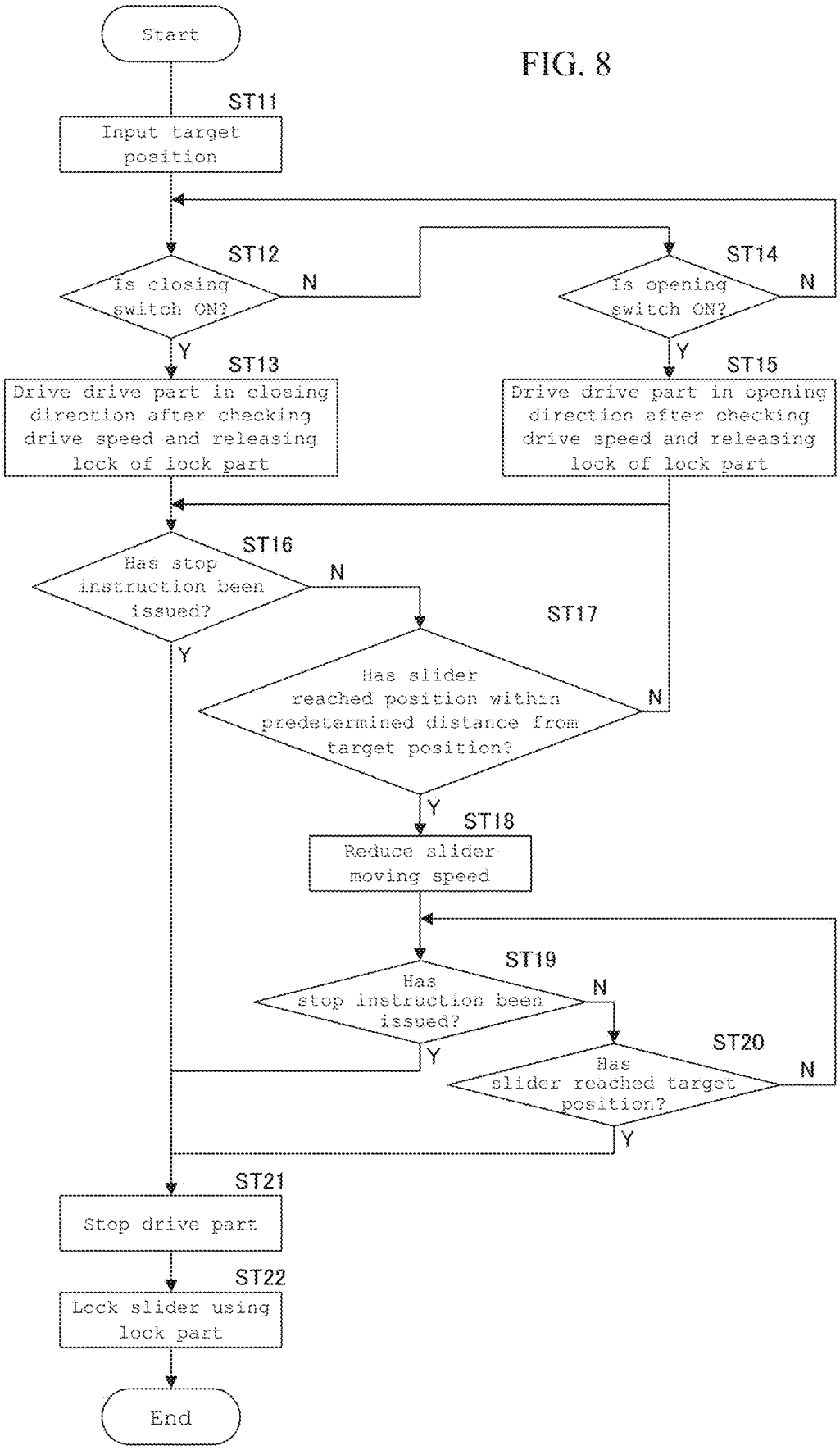
FIG. 8 is a control flow of the electric slide fastener system according to the second embodiment.

FIG. 8 is a control flow of the electric slide fastener system 10 according to the second embodiment.

Upon turning ON of the power switch 71, the control part 80 (FIG. 7) of the electric slide fastener system 10 according to the second embodiment starts its control operation.

In step 11, the target position input part 78 inputs a target position (ST11). The input target position is displayed on the position display part 94.

Then, in step 12, it is determined whether or not the closing switch 72 is turned ON (ST12). When it is determined in step 12 that the closing switch 72 is turned ON, the flow proceeds to step 13. On the other hand, when it is determined in step S12 that the closing switch 72 is not turned ON, the flow proceeds to step 14.

In step 13, after checking of the drive speed and release of the lock of the lock part 93, the drive part 91 is driven in the closing direction (ST13). Then, the flow proceeds to step 15. When the lock part 93 is not provided, the release of the lock part 93 is not executed.

In step 14, it is determined whether or not the opening switch 73 is turned ON (ST14). When it is determined in step 14 that the opening switch 73 is turned ON, the flow proceeds to step 15. On the other hand, when it is determined in step 14 that the opening switch 73 is not turned ON, the flow returns to step 12.

In step 15, after checking of the drive speed and release of the lock of the lock part 93, the drive part 91 is driven in the opening direction (ST15). Then, the flow proceeds to step 16. When the lock part 93 is not provided, the release of the lock part 93 is not executed.

In step 16, it is determined whether or not a stop instruction has been issued (ST16). In the second embodiment, the stop instruction is issued when the stop switch 74, closing detecting sensor 75 or opening detecting sensor 76 is turned ON. The determination of turning ON of the stop switch 74 is made by determining whether or not the stop switch 74 is turned ON by an operator. The determination of turning ON of the closing detecting sensor 75 or opening detecting sensor 76 is made by determining whether or not the slider 6 reaches the front stoppers 4 or back stopper 5.

When it is determined in step 16 that a stop instruction has been issued, the flow proceeds to step 21. On the other hand, when it is determined in step 16 that no stop instruction has been issued, the flow returns to step 17.

In step 17, it is determined whether or not the slider 6 reaches a position within a predetermined distance from the target position (ST17). The determination of whether or not the slider 6 reaches a position within a predetermined distance from the target position can be made by determining whether or not the distance from the position of the slider 6 detected by the position sensor 79 to the target position input to the target position input part 78 is smaller than a prescribed distance.

When it is determined in step 17 that the slider 6 reaches a position within a predetermined distance from the target position, the flow proceeds to step 18. On the other hand, when it is determined in step 17 that the slider 6 does not reach a position within a predetermined distance from the target position, the flow returns to step 16.

In step 18, the moving speed of the slider 6 is reduced (ST18). The speed reduction of the slider 6 is made by using a method that reduces the rotation of the drive part 91 or a method that uses a not-shown transmission part to change the rotational speed transmitted from the drive part 91 to the transmitting part 92.

In step 19, it is determined whether or not a stop instruction has been issued (ST19). The determination of whether or not a stop instruction has been issued is made in the same manner as in step 16.

When it is determined in step 19 that a stop instruction has been issued, the flow proceeds to step 21. On the other hand, when it is determined in step 19 that no stop instruction has been issued, the flow proceeds to step 20.

In step 20, it is determined whether or not the slider 6 reaches the target position (ST20). The determination of whether or not the slider 6 reaches the target position is made by determining whether or not the distance from the position of the slider 6 detected by the position sensor 79 to the target position input to the target position input part 78 is 0.

When it is determined in step 20 that the slider 6 has reached the target position, the flow proceeds to step 21. On the other hand, when it is determined in step 20 that the slider 6 has not reached the target position, the flow returns to step 19.

In step 21, the drive part 91 is stopped based on the stop instruction (ST21). The stop of the drive part 91 stops the slider 6. When the stop switch 74 is turned ON, the slider 6 is stopped at that position. When the closing detecting sensor 75 is turned ON, the slider 6 is stopped in a state where it contacts the front stoppers 4. When the opening detecting sensor 76 is turned ON, the slider 6 is stopped in a state where it contacts the back stopper 5.

Then, in step 22, the lock part 93 is moved to lock the movement of the slider 6 (ST22). When the lock part 93 is not provided, step 22 is not executed.

As described above, by thus controlling the electric slide fastener, the state of the slider 6 can be detected, and the slider 6 can be controlled according to the detected state, whereby adequate operation of the slider 6 can be achieved. Further, the slider 6 can be stopped at a desired position, enhancing user convenience and friendliness. Further, the moving speed of the slider 6 is reduced when the slider 6 reaches a position within a predetermined distance from the target position, so that rapid speed change can be suppressed to reduce faults.

Further, when the lock part 93 is provided, the lock part 93 can lock the movement of the slider 6 relative to the slide fastener chain 1 after the stop of the slider 6, so that the slider 6 can be stably stopped at a desired position, enhancing user convenience and friendliness.

Further, the position display part 94 that displays the target position input by the target position input part 78 and the position of the slider 6 detected by the position sensor 79 is provided, so that it is possible to instantaneously determine the position of the slider 6 relative to the target position.

Figure 9:
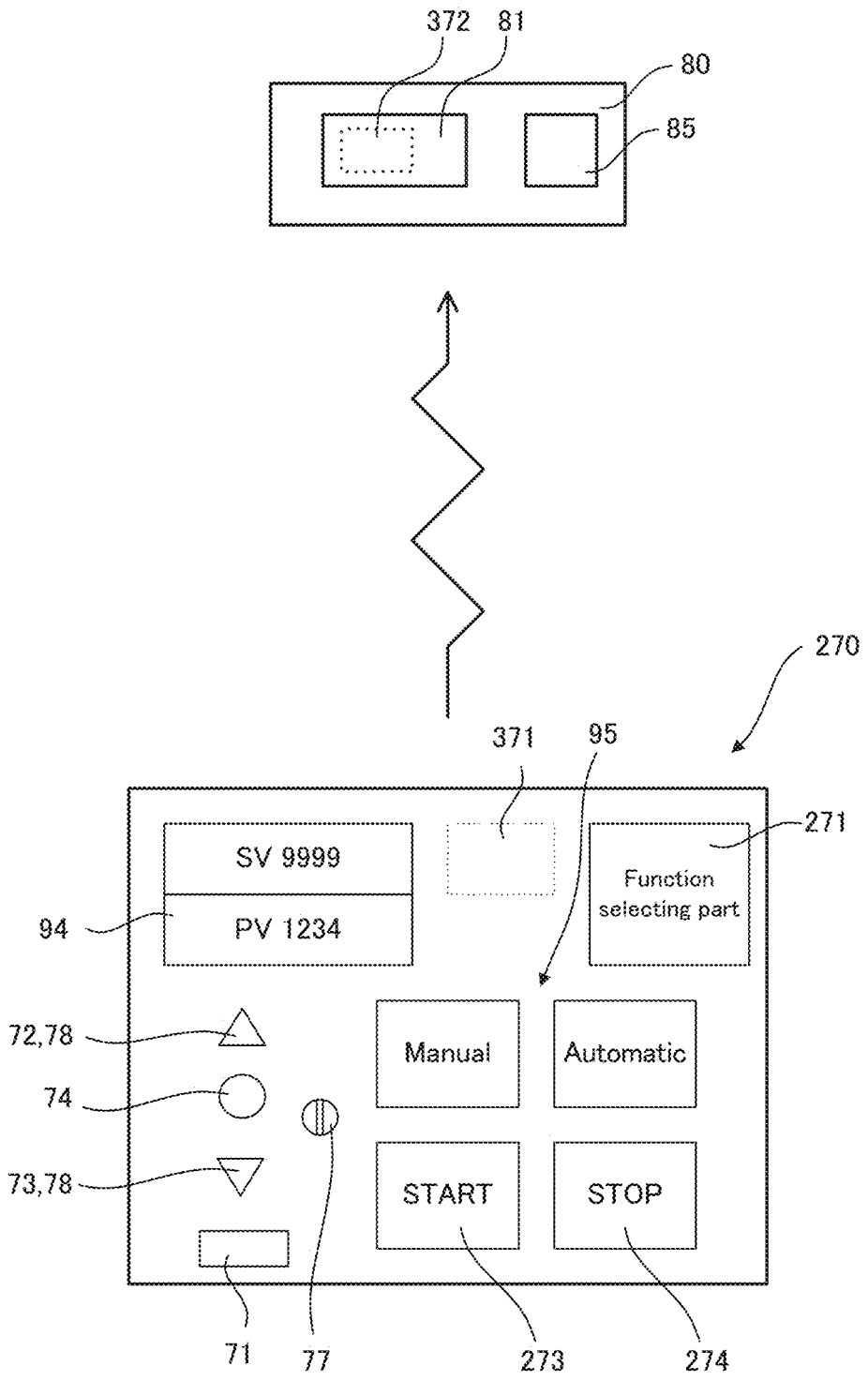
FIG. 9 illustrates a radio input part of the electric slide fastener system according to the second embodiment.

FIG. 9 illustrates a radio input part 270 of the electric slide fastener system 10 according to the second embodiment.

The radio input part 270 is provided in the control unit 7 and includes a power switch 71, a closing switch 72, an opening switch 73, a stop switch 74, a drive speed change switch 77, a target position input part 78, and a position display part 94, as is the case with the slider 6. However, in the second embodiment, the closing switch 72 and the opening switch 73 each also serve as the target position input part 78.

The function as the closing and opening switches 72 and 73 and the function as the target position input part 78 are switched between manual control and automatic control. Under the manual control, the switches 72 and 73 function as the closing switch 72 and opening switch 73, respectively. In this case, pressing the switch moves the slider 6 in the closing or opening direction, and pressing the stop switch 74 stops the slider 6. Under the automatic control, these switches function as the target position input part 78. In this case, pressing each of these switches inputs the target position, and pressing the stop switch 74 resets the target position.

Unlike the input part 70 of the control unit 7 provided in the slider 6, the radio input part 270 includes a function selecting part 271, a start button 273, a stop button 274, and a manual/automatic switching display part 95.

The function selecting part 271 is a button for switching among a manual mode in which the slider 6 is manually moved, an automatic mode in which the slider 6 is automatically moved to and stopped at a predetermined target position, a target position input mode in which a predetermined target position is input, and the other modes (failure diagnosis mode, operation instruction mode by voice, etc.). The automatic mode may be automatic stop control at the stroke end as described in the first embodiment of the present specification, target position stop control as described in the second embodiment, or a combination thereof. The manual mode refers to a mode in which the slider 6 is moved while an operation instruction switch like the closing switch 72 or opening switch 73 is being pressed by an operator's finger. For example, when the button of the target position input part 78 is pressed in the target value input mode, the target position can be set by the number of the elements 3, distance from the current position of the slider 6, distance from the front stoppers 4 or back stopper 5, or time. The selected content is preferably displayed in the form of a character string or a numeric string as displayed on the position display part 94 of FIG. 9. When a configuration not requiring a change in the target value is adopted, the target value may be previously input to the storage part 85, thereby eliminating the need to provide the target value input mode. Further, when the manual mode or automatic mode is selected, the character part of "manual" or "automatic" displayed on the manual/automatic switching display part 95 of FIG. 9 is preferably lit according to the selected content.

The start button 273 is a switch for starting the movement of the slider 6 after the target position is set in the automatic mode. The stop button 274 is a switch for emergency stop.

The radio input part 270 transmits signals to the control part 80 of the slider 6 by radio. The radio input part 270 has a first radio signal conversion part 371 that generates a radio signal according to the setting value set in the target position input part 78. The first radio signal conversion part 371 has a function of generating a radio signal corresponding not only to the setting value set in the target position input part 78, but also to operations of all the switches and buttons provided in the radio input part 270. The control part 80 has a reception part 81 that receives the signal from the radio input part 270. The control part 80 has a second radio signal conversion part 372 that converts the received radio signal according to the value set in the target position input part 78 into a signal to be stored in the storage part 85 of the control part 80 of the slider 6. The second radio signal conversion part 372 has a function of converting all the radio signals transmitted from the radio input part 270 into electrical signals required for controlling the slider 6.

As the radio input part 270, a touch panel type mobile communication terminal may be used. Specifically, a mobile communication terminal like a smartphone may be used. In this case, the mobile communication terminal is preferably operated by a dedicated application. Further, in this case, button arrangement illustrated in FIG. 9 may be displayed as the radio input part 270 on the screen of the mobile communication terminal.

As described above, using the radio input part 270 allows control of the slider 6 even from a position remote from the slider 6. Further, the state of the slider 6 can be adequately recognized.

Next, a system for externally feeding power used for the electric slide fastener system 10 according to the present embodiments will be described.

Figure 10:
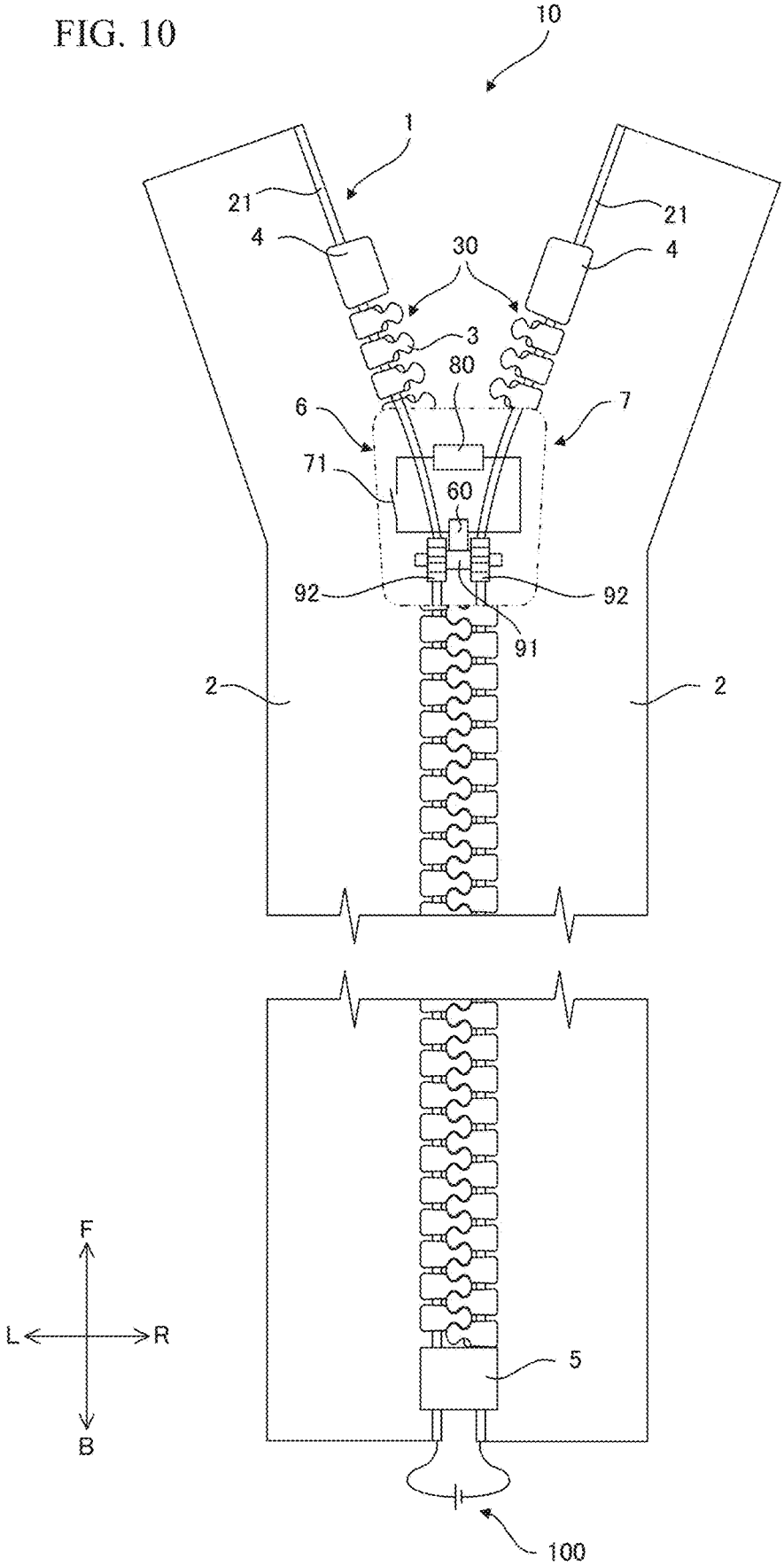
FIG. 10 illustrates a feeding system applicable to the electric slide fastener system according to the present embodiments.

FIG. 10 illustrates a feeding system applicable to the electric slide fastener system 10 according to the present embodiments.

In the feeding system illustrated in FIG. 10, the opposing conductive parts 21 of the respective fastener tapes 2 are each made of a conductive material. In the conductive parts 21, current flows from an external power supply 100 of DC 5 V to 24 V. The current flows from the conductive parts 21 to the control part 80 and the drive part 91 through the transmitting part 92, the power supply 60 and the power switch 71. In a first example, the transmitting part 92 is a conductive gear. The drive part 91 rotates the transmitting part 92 to thereby move the slider 6.

As described above, power feeding can be achieved by using the conductive parts 21 of the fastener tape 2, whereby it is possible to stably feed power while effectively utilizing a space. Further, the transmitting part 92 to be driven by the drive part 91 serves also as a contact part 113 electrically connected to each conductive part 21, so that the number of parts can be reduced.

Figure 11:
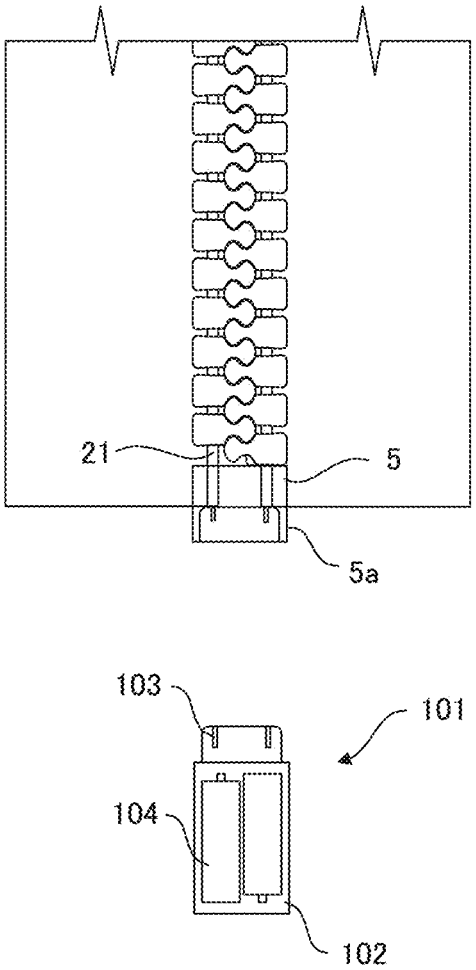
FIG. 11 illustrates an example in which an external battery unit is used for the feeding system illustrated in FIG. 10.

FIG. 11 illustrates an example in which an external battery unit 101 is used for the feeding system illustrated in FIG. 10.

In place of power feeding from the external power supply in the feeding system illustrated in FIG. 10, an external battery unit 101 as illustrated in FIG. 11 may be used. The external battery unit 101 has a unit side connector 103 in a case 102 for housing a battery 104. Correspondingly, the back stopper 5 of the slide fastener chain 1 has a back stopper side connector 5*a* that can be connected to the connector 103. Thus, connecting the unit side connector 103 of the external battery unit 101 to the back stopper side connector 5*a* allows current to flow to the control part 80 and the drive part 91 through the transmitting part 92 and the power switch 71, as in the case of the example illustrated in FIG. 10.

As described above, by using the external battery unit 101, power feeding can be achieved easily.

Figure 12:
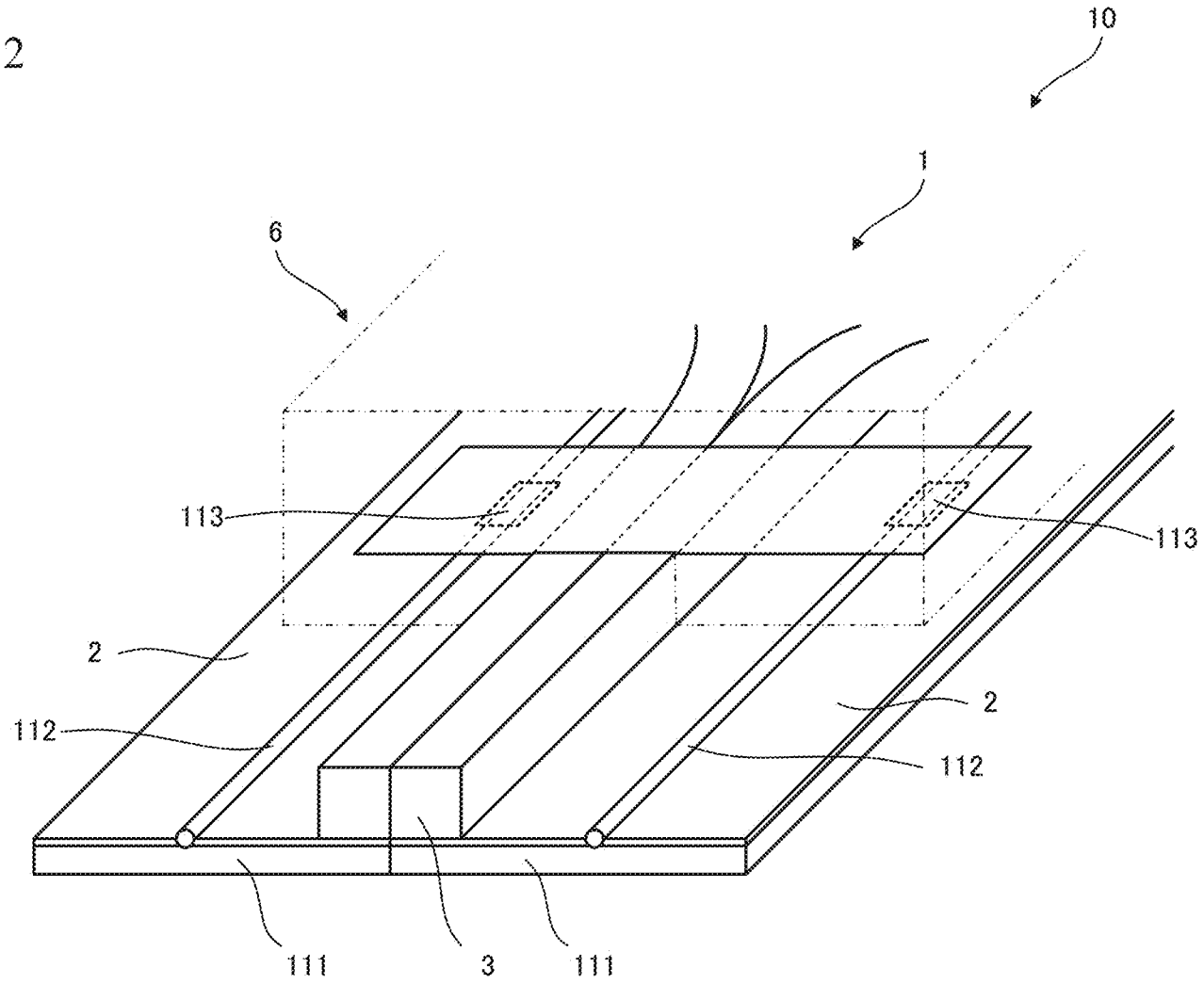
FIG. 12 illustrates a feeding system applicable to a case where a slide fastener chain of the electric slide fastener system according to the present embodiments has a waterproof function.
Figure 13:
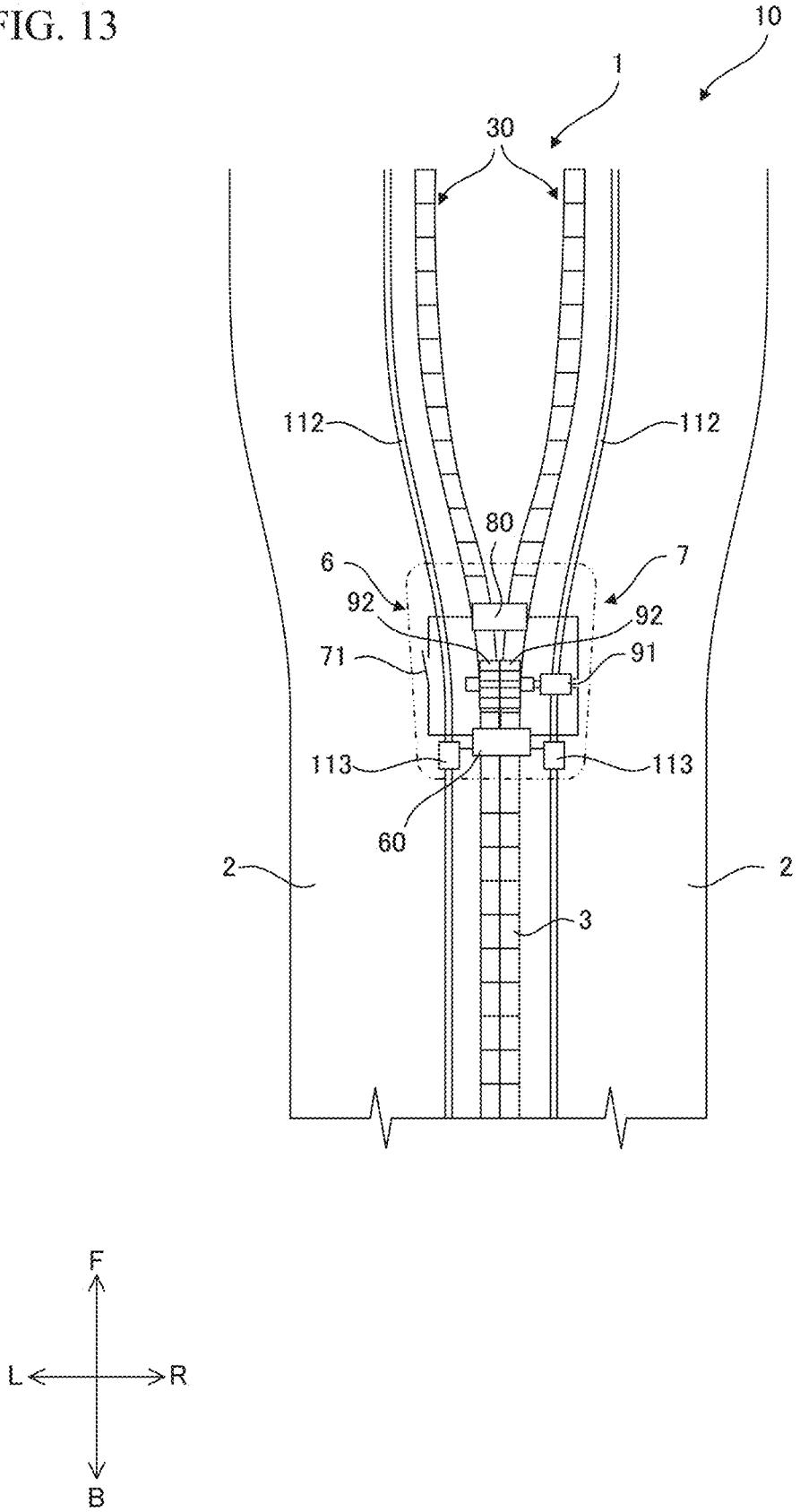
FIG. 13 is a front view of the electric slide fastener system having a waterproof function.

FIG. 12 illustrates a feeding system applicable to a case where the slide fastener chain 1 of the electric slide fastener system 10 according to the present embodiments has a waterproof function. FIG. 13 is a front view of the electric slide fastener system 10 having a waterproof function. FIG.

14 illustrates a contact part 113 of the electric slide fastener system 10 having a waterproof function.

When the slide fastener chain 1 has a waterproof function, a resin coating part 111 is provided on one side of the fastener tapes 2 and elements 3 opposite to the slider 6. Further, the fastener tapes 2 have the conductive parts 112, respectively, along the element strips 30. Further, the slider 6 has contact parts 113 contacting the conductive parts 112, respectively. The contact parts 113 are included in the control unit 7 and contact the respective conductive parts 112 to thereby feed power supplied from the external power supply 100 of FIG. 10 or external battery unit 101 of FIG. 11 to the control part 80 and the drive part 91 through the power supply 60 and the power switch 71. That is, the conductive parts 112 and the contact parts 113 are included in a feeding mechanism for feeding power to the power supply 60. In this embodiment, the rechargeable power supply 60 is provided on the slider 6; alternatively, however, the power supply 60 may be omitted. In this case, externally supplied power is fed to the control part 80 and the drive part 91 through the power switch 71.

Figure 14:
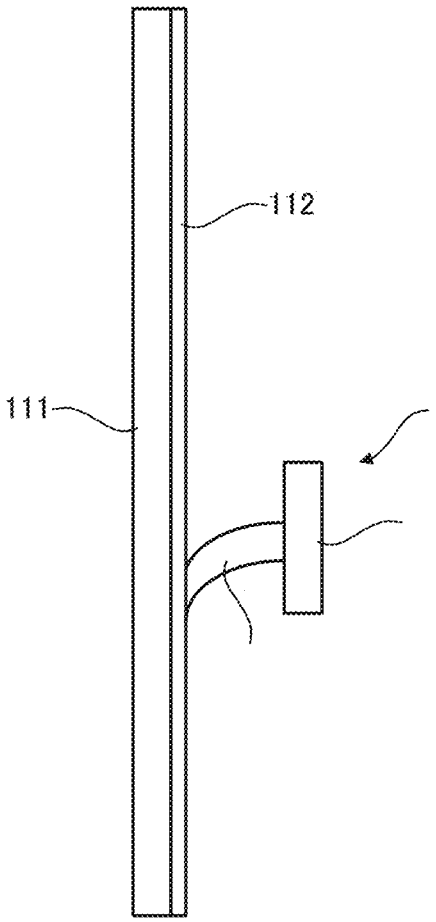
FIG. 14 illustrates a contact part of the electric slide fastener system having a waterproof function.

The contact parts 113 each include a contact part body 113*a* and a contact 113*b* extending from the contact part body 113*a* and contacting the conductive part 112. The contact 113*b* is made of a material having flexibility and conductivity. The contact 113*b* has a length slightly longer than the distance from the contact part body 113*a* to the conductive part 112. Thus, as illustrated in FIG. 14, the contact 113*b* can contact the conductive part 112 even during the movement of the slider 6.

As described above, even when the slide fastener chain 1 has a waterproof function, stable power feeding can be achieved.

In the example of FIG. 10, the transmitting part 92 serves also as the contact part 113. That is, in the example of FIG. 10, the transmitting parts 92 contact the respective conductive parts 112 to thereby feed power supplied from the external power supply 100 of FIG. 10 or the external battery unit 101 of FIG. 11 to the control part 80 and the drive part 91 through the power switch 71. Thus, the transmitting part 92 serves as the contact part.

Figure 15:
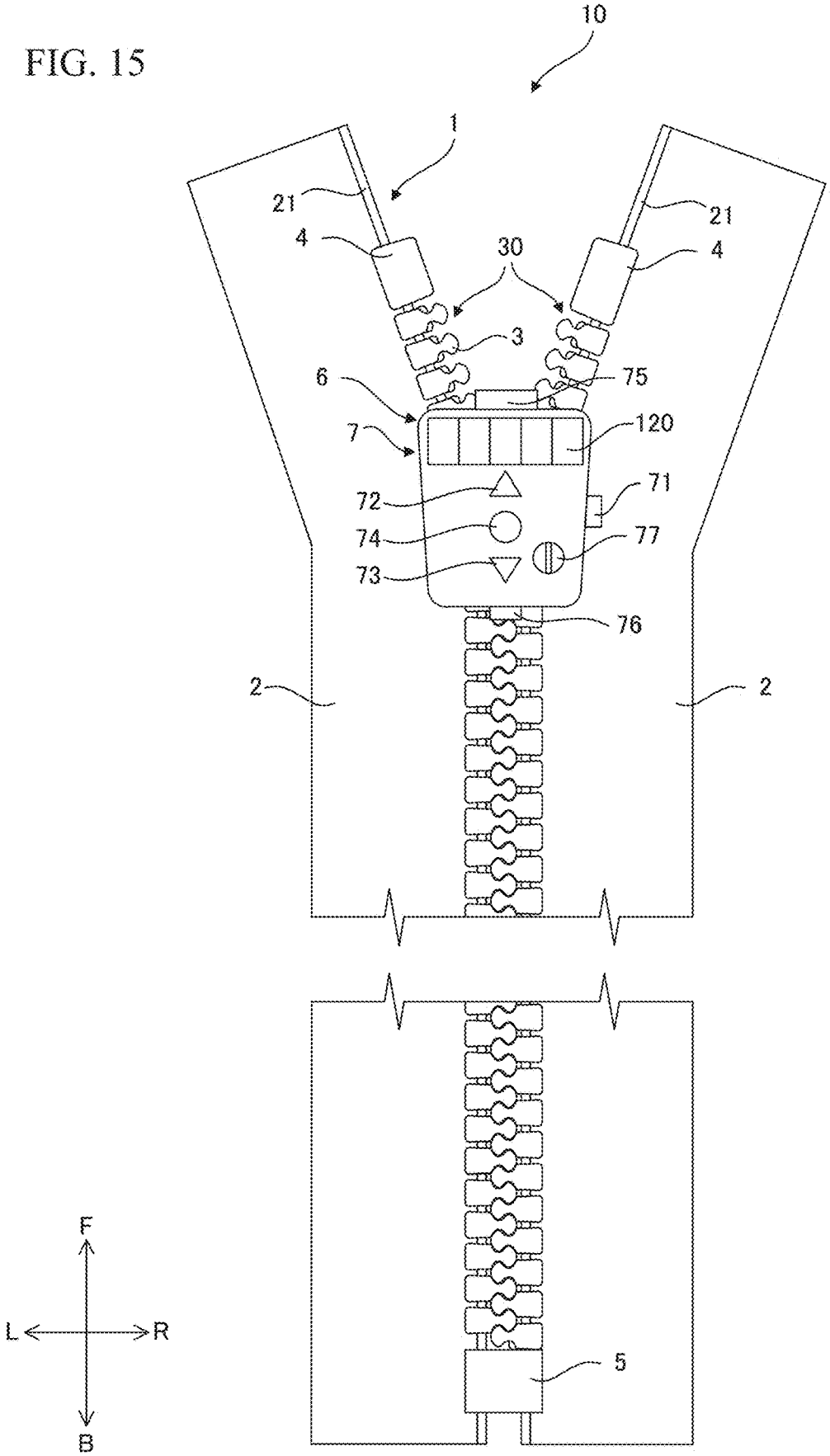
FIG. 15 illustrates another feeding system applicable to the electric slide fastener system according to the present embodiments.

FIG. 15 illustrates another feeding system applicable to the electric slide fastener system 10 according to the present embodiments.

In the example of FIG. 15, a solar panel 120 is provided in the control unit 7 of the slider 6 as the power supply 60. The solar panel 120 is preferably installed at the upper position of the slider 6, where sufficient levels of sunlight can hit the panel 120.

By thus using the solar panel 120 as an external feeding mechanism, it is possible to feed power to the drive part 91 while charging the power supply 60, thus allowing stable power feeding to be achieved while effectively utilizing a space.

As described above, the electric slide fastener system 10 according to the present embodiments is provided with: a slide fastener chain 1 including a pair of fastener tapes 2 and element strips 30 including a plurality of elements 3 fixed to the fastener tapes 2; a slider 6 configured to be movable relative to the slide fastener chain 1 and including at least a power supply 60, a control part 80 including a reception part 81 for receiving a radio signal, and an output part 90 including a drive part 91 for driving an electric motor and a transmitting part 92 for transmitting a drive force to the element strips 30; and a radio input part 170 (270) for transmitting by radio an instruction signal to the slider 6. Thus, the electric slide fastener system 10 of the present embodiments can be adequately operated according to the state of the electric slider.

In the electric slide fastener system 10 according to the present embodiments, the radio input part 170 (270) includes at least a closing switch 72 for transmitting a radio signal for moving the slider 6 in a direction closing the slide fastener chain 1 and an opening switch 73 for transmitting a radio signal for moving the slider 6 in a direction opening the slide fastener chain 1. Thus, according to the electric slide fastener system 10 of the present embodiments, it is possible to control the opening/closing operation of the slider 6 even from a position remote from the slider 6.

In the electric slide fastener system 10 according to the present embodiments, the radio input part 270 has a target position input part 78 for inputting a target position to which the slider 6 is moved. Thus, according to the electric slide fastener system 10 of the present embodiments, the slider 6 can be stopped at a desired position, enhancing user convenience and user friendliness.

In the electric slide fastener system 10 according to the present embodiments, the radio input part 270 has a function selecting part 271. The function selecting part 271 can select one mode from at least two modes. The two modes include a combination of a manual mode in which the slider 6 is moved while the radio input part 270 is manually operated and an automatic mode in which the slider 6 is automatically moved to and stopped at a predetermined target position, or a combination of the automatic mode in which the slider 6 is automatically moved to and stopped at a predetermined target position and a target position input mode in which a predetermined target position is input. Thus, according to the electric slide fastener system 10 of the present embodiments, a use can adequately select a desired mode according to circumstances, enhancing user convenience and user friendliness.

In the electric slide fastener system 10 according to the present embodiments, the radio input part 270 has a position display part 94 for displaying the current position of the slider 6. Thus, according to the electric slide fastener system 10 of the present embodiments, the position of the slider 6 relative to a target position can be instantaneously determined.

In the electric slide fastener system 10 according to the present embodiments, the radio input part 170 (270) is a touch panel type mobile communication terminal. Thus, electric slide fastener system 10 of the present embodiments can be easily operated using an existing terminal.

A radio transmitter according to the present embodiments is a radio input part 170 (270) as a radio transmitter for transmitting a radio signal to a slider 6 for opening/closing a slide fastener so as to remotely control the slider 6. The radio input part 170 (270) includes at least a closing switch 72 for transmitting a radio signal for moving the slider 6 in a direction closing the slide fastener chain 1, an opening switch 73 for transmitting a radio signal for moving the slider 6 in a direction opening the slide fastener chain 1, and a stop switch 74. The radio input part 170 (270) optionally has a first radio signal conversion part 171 (271) that generates a radio signal according to an operation time for the closing switch 72, opening switch 73 and stop switch 74. Thus, according to the radio transmitter of the present embodiments, the electric slider can be adequately operated according to the state thereof.

A radio transmitter according to the present embodiments is a radio input part 270 as a radio transmitter for transmitting a radio signal to a slider 6 for opening/closing a slide fastener so as to remotely control the slider 6. The radio input part 270 has a target position input part 78 for inputting a target position to which the slider 6 is moved. The radio input part 270 further has a first radio signal conversion part 271 that generates a radio signal according to a setting value set in the target position input part 78. Thus, according to the radio transmitter of the present embodiments, the electric slider can be adequately operated according to the state thereof.

In the radio transmitter according to the present embodiments, the radio input part 270 has a start button 273 for starting, after the target position is set, the movement of the slider 6 to the target position, and the first radio signal conversion part 271 generates a radio signal according to the operation state of the start button 273. Thus, according to the radio transmitter of the present embodiments, the slider 6 can be speedily and adequately operated, enhancing user convenience and user friendliness.

A slider 6 as a radio receiver according to the present embodiments is a slider 6 as a radio receiver for receiving a radio signal for opening/closing a slide fastener. The radio receiver has a second radio signal conversion part 172 that converts a radio signal transmitted thereto according to the operation state of a closing switch 72 and an opening switch 73 of a radio input part 170 (270) as a radio transmitter into a drive signal for a drive part 91 of the slider 6. Thus, the electric slider 6 as the radio receiver of the present embodiments can be adequately operated according to the state thereof.

A slider 6 as a radio receiver according to the present embodiments is a slider 6 as a radio receiver for receiving a radio signal for opening/closing a slide fastener. The radio receiver has a second radio signal conversion part 272 that converts a radio signal transmitted thereto according to a value set in a target position input part 78 of a radio input part 270 as a radio transmitter into a signal to be stored in a storage part 85 of a control part 80 of the slider 6. Thus, the electric slider 6 as the radio receiver of the present embodiments can be adequately operated according to the state thereof.

In the slider 6 as the radio receiver according to the present embodiments, the second radio signal conversion part 272 converts a radio signal transmitted thereto according to the operation state of a start button 273 of the radio input part 270 as the radio transmitter into a signal for start-up of a drive part 91 of the slider 6. Thus, the electric slide fastener system 10 according to the present embodiments makes it possible to operate the slider 6 speedily and adequately, enhancing user convenience and user friendliness.

While the various embodiments of the present invention have been described, the present invention is not limited to these embodiments, and an embodiment obtained by appropriately combining configurations of the different embodiments are also included in the scope of the present invention.

REFERENCE SIGNS LIST

1: Slide fastener chain
10: Electric slide fastener system
2: Fastener tape
21: Conductive part
3: element
4: Front stopper
5: Back stopper
5*a*: Back stopper side connector
6: Slider (radio receiver)
60: Power supply
7: Control unit
70: Input part
71: Power switch
72: Closing switch
73: Opening switch
74: Stop switch
75: Closing detecting sensor
76: Opening detecting sensor
77: Drive speed change switch
78: Target position input part
79: Position sensor
80: Control part
85: Storage part
90: Output part
91: Drive part
92: Transmitting part (contact part)
93: Lock part
94: Position display part
95: Manual/automatic switching display part
100: External power supply
101: External battery unit
102: Case
103: Unit side connector
104: Battery
111: Resin coating part
112: Conductive part
113: Contact part
113*a*: Contact part body
113*b*: Contact
170, 270: Radio input part (radio transmitter)
171, 371: First radio signal conversion part
172, 372: Second radio signal conversion part

The invention claimed is:

1. An electric slide fastener system comprising:

a slide fastener chain including a pair of fastener tapes and element strips including a plurality of elements fixed to the fastener tapes;

a slider configured to be movable relative to the slide fastener chain and including at least a power supply, a control part including a reception part for receiving a radio signal, and an output part including a drive part for driving an electric motor and a transmitting part for transmitting a drive force to the element strips; and a radio input part for transmitting by radio an instruction signal to the slider, wherein the radio input part includes at least a closing switch for transmitting a radio signal for moving the slider in a direction closing the slide fastener chain and an opening switch for transmitting a radio signal for moving the slider in a direction opening the slide fastener chain.

2. The electric slide fastener system according to claim 1, wherein the radio input part has a function selecting part, and the function selecting part can select one mode from at least two modes, the two modes including a combination of a manual mode in which the slider is moved while the radio input part is manually operated and an automatic mode in which the slider is automatically moved to and stopped at a predetermined target position, or a combination of the automatic mode in which the slider is automatically moved to and stopped at a predetermined target position and a target position input mode in which a predetermined target position is input.

3. The electric slide fastener system according to claim 1, wherein the radio input part is a touch panel type mobile communication terminal.

4. An electric slide fastener system comprising:

a slide fastener chain including a pair of fastener tapes and element strips including a plurality of elements fixed to the fastener tapes;

a slider configured to be movable relative to the slide fastener chain and including at least a power supply, a control part including a reception part for receiving a radio signal, and an output part including a drive part for driving an electric motor and a transmitting part for transmitting a drive force to the element strips; and a radio input part for transmitting by radio an instruction signal to the slider, wherein the radio input part has a target position input part for inputting a target position to which the slider is moved.

5. An electric slide fastener system comprising:

a slide fastener chain including a pair of fastener tapes and element strips including a plurality of elements fixed to the fastener tapes;

a slider configured to be movable relative to the slide fastener chain and including at least a power supply, a control part including a reception part for receiving a radio signal, and an output part including a drive part for driving an electric motor and a transmitting part for transmitting a drive force to the element strips; and a radio input part for transmitting by radio an instruction signal to the slider, wherein the radio input part has a position display part for displaying a current position of the slider.

6. A radio transmitter which is a radio input part as a radio transmitter for transmitting a radio signal to a slider for opening/closing a slide fastener so as to remotely control the slider, comprising:

a closing switch for transmitting a radio signal for moving the slider in a direction closing a slide fastener chain;

an opening switch for transmitting a radio signal for moving the slider in a direction opening the slide fastener chain; and a stop switch, and optionally comprising a first radio signal conversion part that generates a radio signal according to an operation time for the closing switch, the opening switch and the stop switch.

7. A radio transmitter which is a radio input part as a radio transmitter for transmitting a radio signal to a slider for opening/closing a slide fastener so as to remotely control the slider, comprising:

a target position input part for inputting a target position to which the slider is moved; and a first radio signal conversion part that generates a radio signal corresponding to a setting value set in the target position input part.

8. The radio transmitter according to claim 7, wherein the radio input part includes a start button for starting, after the target position is set, a movement of the slider to the target position, and the first radio signal conversion part generates a radio signal corresponding to an operation state of the start button.

9. A slider which is a radio receiver for receiving a radio signal for opening/closing a slide fastener, comprising:

a second radio signal conversion part that converts a radio signal transmitted thereto according to an operation state of a closing switch and an opening switch of a radio input part as a radio transmitter into a drive signal for a drive part of the slider.

10. A slider which is a radio receiver for receiving a radio signal for opening/closing a slide fastener, comprising:

a second radio signal conversion part that converts a radio signal transmitted thereto according to a value set in a target position input part of a radio input part as a radio transmitter into a signal to be stored in a storage part of a control part of the slider.

11. The slider according to claim 10, wherein the second radio signal conversion part converts the radio signal transmitted thereto according to an operation state of a start button of the radio input part as the radio transmitter into a signal for start-up of a drive part of the slider.

* * * * *